United States Patent [19]

Murao

[11] 4,339,852

[45] Jul. 20, 1982

[54] CLEARER DEVICE FOR DRAFT ROLLS

[76] Inventor: Yoshio Murao, No. HA-173, Nukaotomaru-cho, Kanazawa-shi, Japan

[21] Appl. No.: 155,966

[22] Filed: Jun. 3, 1980

[30] Foreign Application Priority Data

Jun. 13, 1979 [JP] Japan ..... 54-75096

[51] Int. Cl.[3] ..... D01H 5/64

[52] U.S. Cl. ..... 19/264

[58] Field of Search ..... 19/245, 262, 264, 265; 15/256.52, 256.53

[56] References Cited

U.S. PATENT DOCUMENTS

| | | | |
|---|---|---|---|
| 2,593,478 | 4/1952 | Newton | 19/262 X |
| 2,735,142 | 2/1956 | Noiles | 19/265 X |
| 2,834,062 | 5/1958 | Toenniessen | 19/262 X |
| 2,951,268 | 9/1960 | West | 19/264 X |

*Primary Examiner*—Louis Rimrodt

*Attorney, Agent, or Firm*—Oblon, Fisher, Spivak, McClelland & Maier

[57] ABSTRACT

This invention relates to a clearer device for use in clearing draft rolls of a spinning machine, and more particularly to a clearer device which is disposed below a series of juxtaposed draft rolls and includes an endless clearer member (hereinafter called an "apron") travelling operatively in contact with the peripheral surfaces of the draft rolls for clearing the draft rolls.

4 Claims, 9 Drawing Figures

CLEARER DEVICE FOR DRAFT ROLLS

BACKGROUND OF THE INVENTION

It is well known that various clearer devices are provided for draft rolls in spinning machines. Those clearer devices can be classified into the top clearer device which is disposed above a draft roll section and the bottom clearer device which is disposed below the draft roll section. The former is generally placed against a set of top rolls and the latter against a set of bottom rolls. It is conventional to provide the top and bottom clearer devices of a same or different configuration, whereas only one of the clearer devices is provided as occasion may require.

Those clearer devices use a clearer member of suitable material which may easily pick off lint and fly carried by the draft rolls, for example, felt, furry cloth, a brush sheet, artificial leather and rubber. There are two types of the clearer devices: the rotary roll type wherein such a clearer member is affixed to a surface of a moving component and kept in contact with the draft rolls and the stationary type wherein the clearer member is secured on a surface of a fixed or stationary component while being in contact with the draft rolls. The former is more useful in long-term, continued operation but less satisfactory as far as clearing performance is concerned. The latter is required to very often remove the fly and failure to do so results in the possibility that the fly accumulated thereon can enter final products. Therefore, a pneumatic clearer has recently been developed and widely used. The mere use of incoming air is however unsatisfactory in removing the accumulated fly and sometimes needs the assistance of brush rolls or the rotary roll type or stationary type clearer. It is general practice to form flutes in the bottom rolls, that is, the draft rolls but the fly or foreign objects enter into the flutes. Accordingly, no complete removal of the fly is assured by only the incoming air.

In order to make use of the advantages of both the rotary type clearer and the stationary type clearer, an apron type of clearer has recently been used which includes the clearer member of an apron shape traveling in contact with the surface of the draft rolls and wiping off the fly at its nonoperative section. The apron type of clearers can be similarly classified into the top apron clearers and the bottom apron clearers. The top and bottom clearers are both installed or one of the both clearers is installed together with the other types of clearers as discussed above.

Of the above clearers, the bottom apron clearer device is needed to be placed below the draft rolls and thus in a limited space so that is should be simple in construction, easy to manipulate and ensure stable and satisfactory clearing performances. Specifically, for the bottom apron clearer it is greatly possible that the fly can enter inside the apron. In particular, within a spinning chamber with an air blower, the fly blown off by air tends to enter inside the bottom and top aprons. It is, therefore, necessary for the apron clearer to remove the fly adhering to not only the outer surface but also the inner surface of the clearer.

SUMMARY OF THE INVENTION

Bearing in mind the foregoing, it is an object of the present invention to provide a clearer device which fulfills all the requirements discussed above.

More particularly, the present invention aims to device a clearer which completely clears a number of draft rolls.

It is another object of the present invention to provide a clearer device for draft rolls which completely removes the lint and fly accumulated on an apron and withstands long-term and continued operation.

Whereas a typical bottom clearer device is shown as being provided for four draft rolls, it is equally applicable to a given number of pairs of the draft rolls. Though those draft rolls are aligned substantially in a horizontal plane in typical embodiments, they may be aligned with a proper inclination. The present clearer device is further applicable to a top apron.

DETAILED DESCRIPTION OF THE INVENTION

A bottom clearer device is generally designated at 1 and so built on a frame assembly 6 as to be rotatable about a pivot 5. The frame assembly 6 is secured on an inclinable stand 7 in front of the frame assembly so that an apron can be held on in contact with draft rolls.

Figure 2:
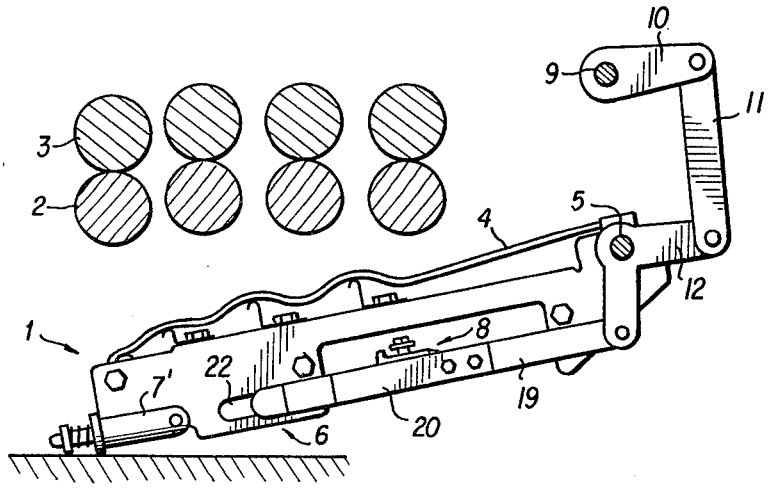
FIG. 2 is a view for explanation of operation of the device of FIG. 1.

The pivot shaft 5 is freely secured on a roll stand (not shown) carrying the draft rolls and located lengthwise of a machine platform and in parallel with a series of the draft rolls. The shaft 5 is reciprocated by a link lever 11 connecting an arm 12 affixed to opposite ends or intermediate portions of the shaft 5 and a second arm 10 affixed to a reciprocating shaft 9. Although in the drawings the arm 12 affixed to the shaft 5 is of an "L" shape with capability of further actuating a transverse lever of a combing device 8 to be discussed later, these drive mechanisms may be separate. Moreover, while the illustrated example comprises the "L" shaped lever 12 connecting the rotary shaft 9 and the shaft 5, it is possible to use only the shaft 5. Bottom rolls and top rolls are indicated at 2 and 3 with the former being fluted rolls. An endless apron 4 is made of the above-mentioned clearer member and supported by the frame assembly 6. The apron 4 rotates in the direction of arrow as the shaft 5 transmits only force of unidirectional rotation to the apron 4. With the stand 7 being inclined as viewed in FIG. 2, the bottom clearer device 1 is open for easy access in maintaining and clearing the apron 4. Under such a circumstance adjustment can be made on the locations of guide plates 18 described below by use of different roll gauges.

Figure 1:
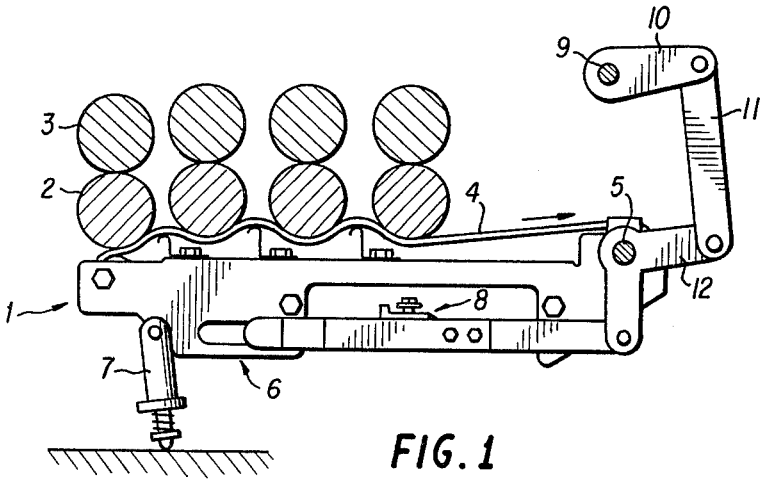
FIG. 1 is a side view of a clearer device constructed in accordance with the present invention.
Figure 4:
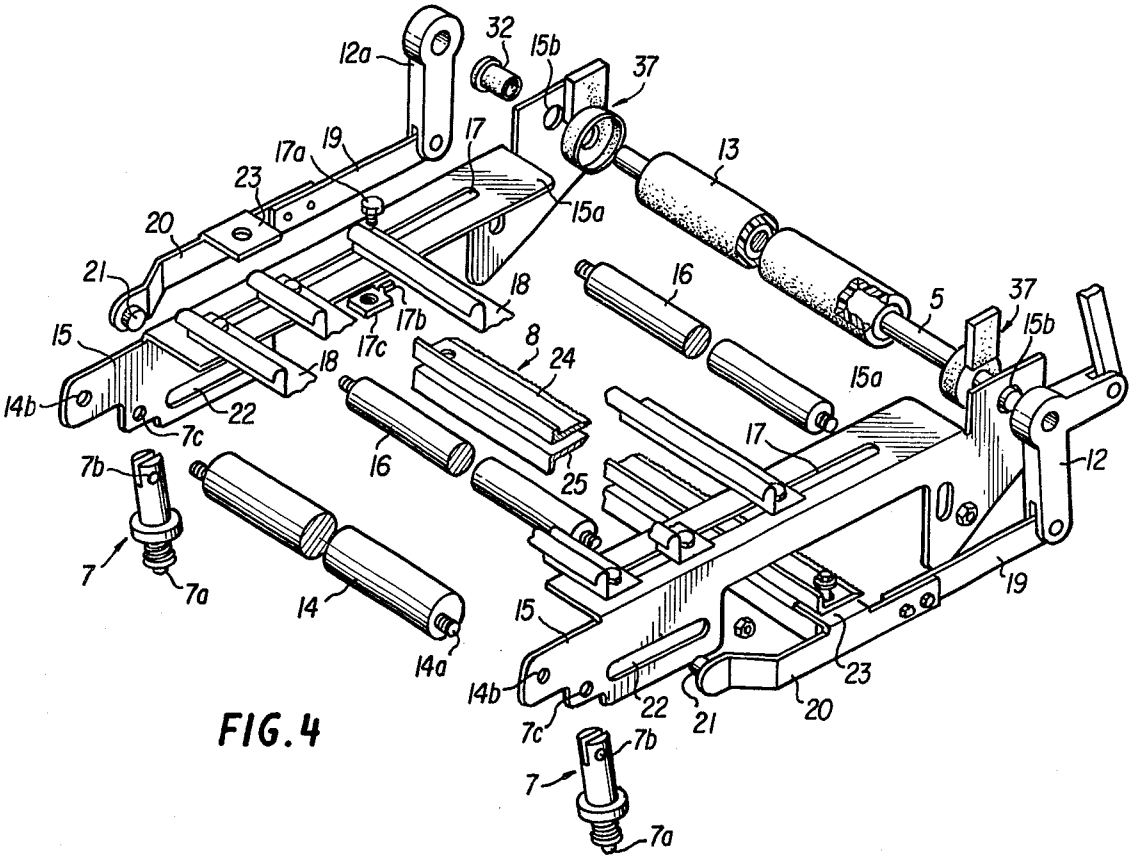
FIG. 4 is an exploded perspective view showing structure of the clearer device exclusive of the apron.

As best shown in FIG. 4, details of structure of the bottom clearer device will be clarified mainly by reference to FIG. 4. The frame assembly 6 has side frames 15,15 with inwardly bent top ends at its both sides, vertical wall sections of the side frames carrying fixing rods 16,16, respectively. On the rear side of the two vertical wall sections, there are cleaved openings 15*b*,15*b* which allow passage of the shaft 5 therethrough so that the frame assembly 6 is integrally rotatably supported by the shaft 5. As will be discussed later, an apron driving roll 13 is mounted on the shaft 5 to move the apron 4 stretched thereacross. Folded horizontal sections 15*a*,15*a* on the top of the opposite side frames 15,15 are provided with slits 17,17 in which the opposite ends of the guide plates 18,18 are received by means of bolts and nuts. The guide plates 18 are of an "L" shaped profile with curved top end portions and serve to raise and guide the apron 4 to a level to contact the draft rolls 2. Since the height and position of the guide plates 18 depend on the arrangement and outer diameter of the draft rolls 2, the guide plates are of a selected height and received freely within the slits 17,17. Fastening bolts 17*a* respectively traverse the slits 17 from above the guide plates 18. It is recommended that a nut 17*c* be provided with a projection 17*b* of which a portion is fitted within the slit 17 to prevent the nut from rotating itself. On the front side of the side frames 15,15 there is provided an apron guide roll 14 whose pivot 14*a* is eccentric and has a screwed shaft section passing through holes 14*b* in the opposite side frames 15,15, and secured with nuts (not shown). The guide roll 14 is fixedly secured and may be located in any desired eccentric position to allow adjustment of tension of the apron 4. The eccentric guide roll 14 may be enclosed by a freely rotatable cylinder so as to minimize resistance to the rotating movement of the apron 4. The stands 7,7 pivoted on front lower sections of the side frames 15,15 are respectively provided with screwed steps 7*a* of an adjustable height and pivots 7*b* received within holes 7*c* so that the stands 7 are inclined somewhat backward as shown in FIG. 1. Slits 22,22 are formed in front lower sections of the vertical walls of the opposite side walls 15,15 to hold a reciprocating lever 20 of a device for picking off the fly carried by the clearer.

Figure 3:
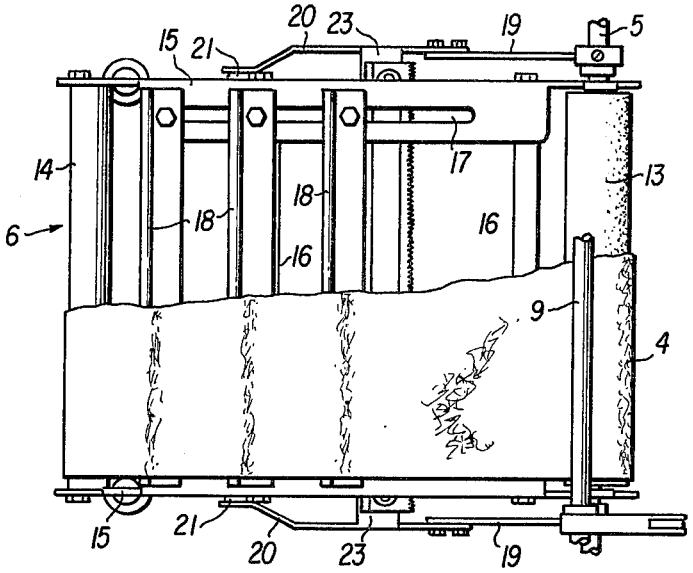
FIG. 3 is a plan view of the clearer device of FIG. 1 with a series of draft rolls omitted and part of an apron broken.

As indicated in FIG. 3, the apron 4 is stretched between the guide roll 14 and the apron driving roll 13 within the frame assembly 6 and driven by the latter roll 13.

While the apron driving roll 13 is supported by the shaft 5, the shaft 5 is reciprocated but is operative to move the apron 4 in only one direction. Accordingly, only unidirectional rotation of the reciprocating movement of the shaft 5 is transmitted to the apron driving tool 13.

Figure 8:
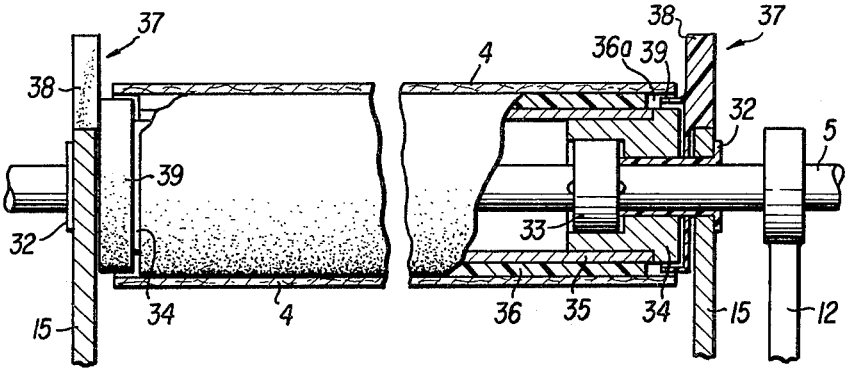
FIG. 8 is a fragmentary front view of an apron roll with the apron shown in section.
Figure 9:
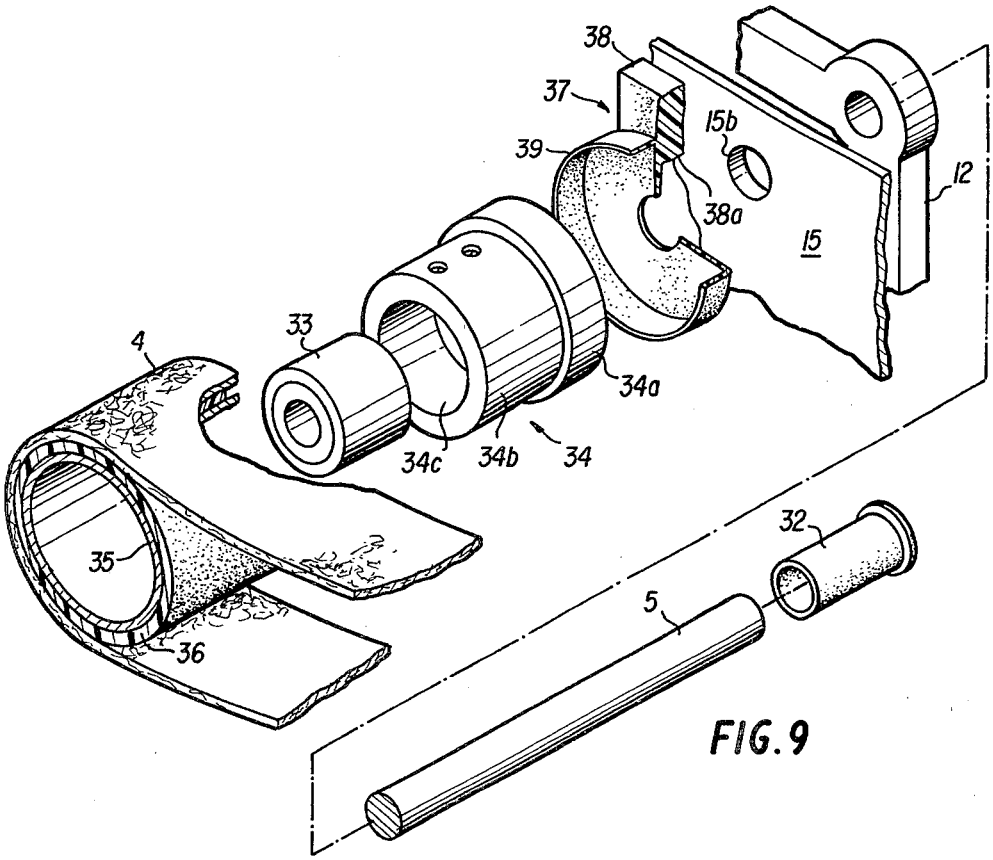
FIG. 9 is an exploded perspective view of part of the structure shown in FIG. 8.

In other words, the apron driving roll 13 is loosely secured around the shaft 5 through journal members 34,34 on both ends of a metallic tube 35 as shown in FIGS. 8 and 9 and freely rotatable via bushings 32,32. One of the journal members 34,34 is coupled to the shaft 5 via a unidirectional clutch 33 so that as the shaft 5 rotates in a reciprocating fashion, it feeds only rotation in one direction to the journal members 34, rotating the tube 35 affixed to the journal member 34 in one direction at a given interval of time. The journal member 34 has a step section 34*b* and a flange section 34*a*, the step section 34*b* holding the tube 35 and having a hole 34*c* receiving the unidirectional clutch 33. The peripheral surface of the tube 35 is covered with an antiskid coating 36 of rugged rubber or metal or other materials having friction resistance by means of fitting or adhering. The coating 36 increases the friction resistance of the apron driving roll 13 and smooths movement of the apron 4. It is desirable to take measures for protecting the friction surface of the apron 4, the journal member 34, the side frames 15 and the friction surface of the bushings 32, since the fly and dust can enter thereto. In the illustrated example, a dust cover 37 is provided. The opposite ends of the coating 36 about the tube 35 are located inside the side edges of the journal member 34. A space 36*a* is formed between the rear side of the apron 4 and the tube 35 or the journal member 34 to accommodate the dust cover 37 having a flange section. The dust cover 37 is of a disc form with the flange portion. To keep the dust cover 37 from rotating, the opposite surface of the flange 39 is provided with an engaging extension 38 whose bottom side 38*a* engages with the top of the side frame 15. The extension 38 serves also as a guide for the apron 4. Preferably, the dust cover 37 is made of plastic.

While being in contact with the bottom rolls 2 of the draft rolls, the apron 4 travels intermittently in the same or opposite direction to movement of the surfaces of the respective rolls, picking off the fly or dust accumulated on the bottom rolls. The apron 4 is provided with the device for wiping off the fly and making the surfaces of the apron clean and fresh. The wiper device generally combs lightly on the operative surface of the apron while traversing the direction of travel of the apron. However, within the bottom apron clearer device, the fly tends to enter inside the apron 4 and curb movement of the apron. The present invention provides an improvement in such a wiper device which clears the apron 4 more completely and keeps on conveying the fly outwardly from one of the opposite sides while removing the fly from the inner surface of the apron 4.

Figure 5:
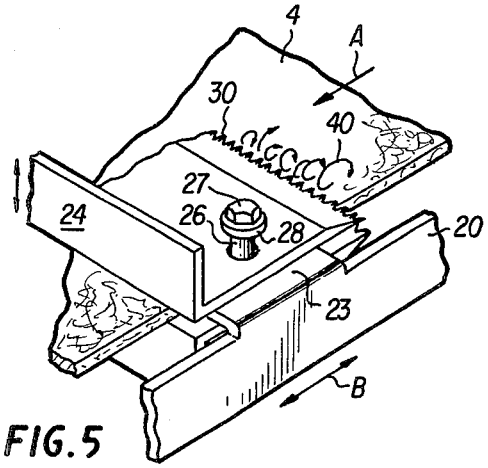
FIG. 5 is an enlarged view showing part of the device of FIG. 4 together with part of the apron.
Figure 6:
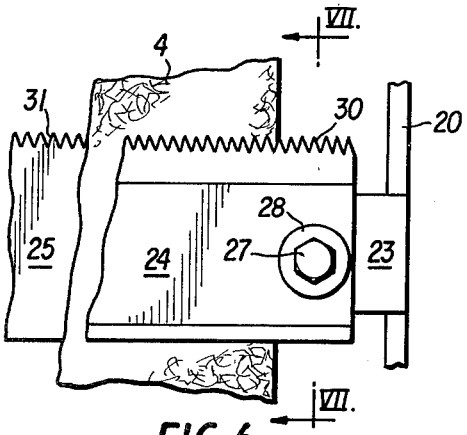
FIG. 6 is a plan view of FIG. 5.
Figure 7:
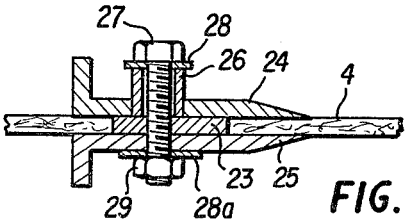
FIG. 7 is a cross sectional view on the line VII—VII, FIG. 6.

As indicated in FIG. 4, the wiper device 8 of FIG. 1 comprises an inner comb plate 24 and an outer comb plate 25 sandwiching the moving lower section of the apron 4, both of which lightly contact and traverse the inner and outer surfaces of the apron 4. The opposite ends of the respective comb plates rest on supports 23,23 which are folded top portions of the respective comb levers 20. The comb levers 20 are secured via the arms 12,12*a* carrying the reciprocating shaft 5 and link rods 19,19 and have inwardly oriented pivots 21,21 at their tip portions. The respective pivots 21 pass through the slits 22 in the vertical wall sections of the side walls 15 while being loosely supported thereby. The supports 23 allow the respective comb plates 24,25 to traverse substantially in parallel with the slits 22. The supports 23 and the comb plates are assembled as depicted in FIGS. 5 through 7. Whereas the outer comb plate 25 abuts against the bottom of the support 23, the inner comb plate 24 falls by gravity and settles on the top of the support 23. This will be more fully understood from a consideration of FIG. 7 wherein the support 23 has an opening for receiving a bolt 27 with its lower side being traversed by the outer comb plate 25 and its upper side by a collar 26 and a washer 28 and a nut 29 is fixed to the outer surface of the outer comb plate 25 via a washer 28*a* to thereby form a stud. The inner comb plate 24 is provided with an opening in which the collar 26 is freely received and thus freely movable between the support 23 and the washer 28. In the drawings the support 23 is shown having the same thickness as that of the apron 4. When the inner comb plate 24 rests on the plate 23 by gravity, the tooth section of the inner comb plate 24 lightly contacts the upper surface (the inner side section) of the apron 4 so that the support 23 is preferably thinner than the apron 4.

The comb tooth in the comb plates applied to the apron clearer are generally of an equilateral triangle with working tooth at the same angle along its traverse direction. The combing plates of the above shape are satisfactory in wiping off the fly and dust picked from the apron or conveying them to a suction device. However, for the combing plates applied to a limited space inside the apron as taught by the present invention, it is desirable to shift forcedly the fly and dust either leftward or rightward and more preferably as the comb plates traverse. Accordingly, the present invention provides an improved combing device which also conveys the fly and dust outwardly in a lateral direction. In other words, as viewed from FIG. 6, the tooth section 30 of the inner comb plate 24 of the combing device 8 consists of straight single-edge sections substantially normal to the traverse direction and working edge sections inclined with respect to the traverse direction, the latter conveying continuously the fly in the direction of a component of force exerted on the inclined surfaces of the working edge sections. When the apron 4 runs in the direction of the arrow A and the comb plates 24,25 traverse in the direction of the arrow B as shown in FIG. 5, the fly 40 is wound in a spiral fashion and conveyed rightward each traversing operation because of the tooth section 30 of the inner comb plate 24 of the shape shown in FIG. 6. If the tooth section 30 of the comb plate 24 is adapted such that each teeth inclines both leftward and rightward along its length, then the fly 40 is distributed in the both directions. The result is that the inner surface of the apron 4 becomes cleared and fresh and the apron travels without slipping even due to accumulation of the fly and dust.

The clearer device according to the present invention offers the following advantages:

(1) it is easy to manipulate;

(2) the draft rolls are always cleared and kept fresh;

(3) the apron is driven steadily and stably;

(4) for the reasons as set forth above manifold spinning machines with the device of the present invention produce high quality products.

What is claimed as new and desired to be secured by Letters Patent of the United States is:

1. An apron clearer device for draft rolls, said apron travelling in contact with lower surface portions of said draft rolls; said clearer device comprising: side frames each having one end pivoted on an intermittently driven shaft to allow the side frames to rotate; an apron driving roll disposed between said side frames for transmitting unidirectional rotation from said intermittently driven shaft via a unidirectional clutch; eccentrically supported apron guide rolls secured on the other end of said side frames; an endless apron stretching between said driving roll and guide rolls; at least two plates secured in a position on said side frames on the inner surface side of said endless apron to force said apron into contact with said draft rolls; stripping combs traversing the lower side of said endless apron in the direction of travel of said apron while sandwiching said apron therebetween, wherein said combs comprise an outer comb for clearing the outer surface side of said apron and an inner comb for clearing the inner surface side of said apron while being in contact with the lower side of said apron under pressure, said combs being driven with said intermittently driven shaft via a swing arm and a rod; and an inclinable stand on the front lower side of said side frames.

2. A clearer device for draft rolls as set forth in claim 1 wherein a surface of said apron driving roll is covered with an antiskid coating.

3. A clearer device for draft rolls as set forth in claim 1 wherein said inner comb has inclined teeth for conveying fly in the direction of the inclination of said teeth.

4. A clearer device for draft rolls as set forth in claim 1 wherein a flange cover with a guide member is disposed on both ends of said apron driving roll and inserted into a space as defined by an antiskid coating on a surface of said apron driving roll and an inner surface of said apron and said guide member prevents said flange cover from rotating on said side frame.

* * * * *